US008613412B1

(12) United States Patent
Donaldson

(10) Patent No.: US 8,613,412 B1
(45) Date of Patent: Dec. 24, 2013

(54) IMPACT ABSORBING SIGN POST WITH FLEXIBLE JOINT AND QUICK CHANGE-OUT SPRING KIT AND METHOD

(76) Inventor: Ronald W. Donaldson, Export, PA (US)

( * ) Notice: Subject to any disclaimer, the term of this patent is extended or adjusted under 35 U.S.C. 154(b) by 209 days.

(21) Appl. No.: 13/136,456

(22) Filed: Aug. 2, 2011

(51) Int. Cl.
*A45F 3/44* (2006.01)
*G09F 15/00* (2006.01)

(52) U.S. Cl.
USPC ..... 248/156; 40/607.1; 40/607.6; 248/548; 404/10

(58) Field of Classification Search
USPC ..... 248/519, 545, 530, 548, 156, 900, 160; 404/10, 11, 13, 606, 608, 9, 12; 40/600, 602, 608, 612, 606.01, 606.11, 40/606.14, 607.1, 607.6; 52/1, 98, 835; 116/63 R
See application file for complete search history.

(56) References Cited

U.S. PATENT DOCUMENTS 1,679,623 A * 8/1928 Olsen ..... 248/160
2,164,680 A 7/1939 Donovan
4,270,873 A * 6/1981 Laehy et al. ..... 404/10
4,565,466 A * 1/1986 Daggs et al. ..... 404/10
4,636,109 A * 1/1987 Clausen et al. ..... 248/156
4,729,690 A * 3/1988 Lavender et al. ..... 404/10
4,806,046 A 2/1989 Clark
5,379,716 A * 1/1995 Helland ..... 116/63 R
5,397,197 A 3/1995 Beavers
6,149,340 A * 11/2000 Pateman ..... 404/10

* cited by examiner

*Primary Examiner* — Tan Le
(74) *Attorney, Agent, or Firm* — R. S. Lombard

(57) ABSTRACT

An impact absorbing sign post with quick change-out capability and method is provided. The impact absorbing sign post includes an upper sign post for carrying a sign, an intermediate cylindrical hollow bollard post carrying the upper sign post and a lower hollow bollard post mounted immovably in the ground supporting the intermediate cylindrical hollow bollard post. A easily removable pivot base flexible joint member with a dome portion is mounted between the intermediate cylindrical hollow bollard post and the lower hollow bollard post. A quick change-out spring kit is housed substantially with the lower hollow bollard post in includes a coil spring that is compressed by a tension means such as a cable or chain. When the sign post is impacted by a vehicle and the spring kit is damaged a replacement quick change-out spring kit may be easily installed after removal of the original spring kit without the necessity of removing the lower hollow bollard post from the ground.

9 Claims, 6 Drawing Sheets

IMPACT ABSORBING SIGN POST WITH FLEXIBLE JOINT AND QUICK CHANGE-OUT SPRING KIT AND METHOD

BACKGROUND OF THE INVENTION

This invention relates to an impact absorbing sign post and, in particular, to a sign post mounted on a bollard-type structure with impact absorbing and quick change-out capabilities.

It is well know that sign posts, such as parking lot sign posts in shopping centers, big box stand alone stores, theaters, sporting event stadiums, and airports, carrying numerous signs, such as handicap parking, directional, stop signs, and others, are often struck by vehicles and seriously damaged to such an extent they require replacement or extensive repair. Often the sign posts are struck with such force to be hit out of the vertical position or they are bent from the impact and the damaged post requires replacement of the post and/or resetting of the solid bollard-type structure in concrete. There is considerable cost incurred with both labor and materials to reset or replace the damaged post.

A flexible parking sign is disclosed in U.S. Pat. No. 2,164,680 issued Jul. 4, 1939 to H. H. Donovan. The Donovan discloses a flexible parking sign including a spring element attached to the above-ground mounted base so as to permit flexing of the sign post upon impact by a vehicle.

A resilient bollard with rotatable collar for alerting vehicles of their location is disclosed in U.S. Pat. No. 5,397,197 issued Mar. 14, 1995 to Dale W. Beavers. The Beavers bollard is made of an elongate member having a lower proximal end biasedly attachable in an upright position to a path surface, an upper distal end, and a longitudinal axis. A collar is attached to the elongate member about its distal end. The collar is rotatable about the longitudinal axis of the elongate member. When the bollard is mounted on or adjacent a vehicle path surface, the bollard is deflectable from its upright position about its proximal end, for example, when contacted by a vehicle. The collar rotates when in contact with the vehicle for following the contour of the vehicle without damaging the vehicle. Mounted atop the bollard may be a light.

Another self-uprighting post is disclosed in U.S. Pat. No. 4,806,046 issued Feb. 21, 1989 to Richard O. Clark. The Clark patent discloses a self-uprighting delineator post comprising a base that may be fixed to a stationary object. A load cell is interposed between the base and delineator post and incorporates upper and lower load cells which are in abutment pivotally disposed. The load cell elements are secured by a pair of cables disposed in side-by-side relation and maintained under tensile stress by open or a pair of compression springs which are subjected to predetermined spring preload. The side-by-side cables fit within aligned passages of the upper and lower load cells serve to insure return of the delineator post to its properly oriented upright position after being force toward the horizontal by an impact force.

Although the prior art discloses sign posts and bollards with the capability to return to vertical after a vehicle impact, the prior art fails to disclose a sign post with a bollard-type lower portion affixed to the ground which absorbs vehicle impacts while providing quick-change out capability of an interior spring mechanism without requiring removal of the bollard-type lower portion from the ground and without requiring the replacement of the whole sign post structure.

SUMMARY OF THE INVENTION

The present invention provides an impact absorbing sign post with quick change-out capability that includes an upper sign post for carrying at least one sign or the like. An intermediate hollow bollard post is positioned below the upper sign post in operative arrangement with the sign post. The upper sign post is removably attached to the intermediate hollow bollard post. A lower hollow bollard post has a first portion of predetermined axial length positioned below ground level and attached to the ground to be immovable, and a second portion of the lower hollow bollard of a predetermined axial length substantially less than the first portion is positioned above ground level.

A pivot base flexible joint member is provided that has a central opening of predetermined size. The pivot base flexible joint member is removably attached to the lower hollow bollard post proximate the second portion thereof. The pivot base flexible joint member includes a top plate sized to cover the top of the second portion of the lower hollow bollard post and is in contacting and supportive relationship with the intermediate hollow bollard post. A dome portion is centrally affixed to the upper surface of the top plate. The dome portion having a circular base having a diameter a predetermined amount less than the inside diameter of the bottom of the intermediate hollow bollard post. The dome portion may have a semi-toroidal shape. The dome portion in operative contacting arrangement with the intermediate hollow bollard post. The central opening of the pivot base flexible joint member passing through the dome portion and the top plate. A removable attachment means is included for attaching the pivot base flexible joint member to the top of the lower bollard post proximate the second portion thereof.

The sign post includes a quick change-out spring kit substantially housed within the lower hollow bollard post. The quick change-out spring kit includes at least one concentric coil spring housed within the lower hollow bollard post in the operative position. The at least one concentric coil spring at the top thereof contacting the bottom surface of the top plate of the pivot base flexible joint member and confined by the pivot base flexible joint member within the lower hollow bollard post.

An elongated tension means axially passes through the at least one coil spring and the central opening of the pivot base flexible joint member. The elongated tension means includes a tension adjustment means near the top portion thereof. The elongated tension means is removably attached near the top thereof in predetermined position to the intermediate hollow bollard post.

A disk-shaped bottom spring contact member having a diameter about equal to or greater than the outer diameter of the bottom coil of the largest of the at least one concentric coil springs is also included. The disk-shaped bottom spring contact member is provided with a second central opening sized to accommodate the passage of the bottom portion of the elongated tension means. A locking member is mounted on the bottom portion of the tension means in cooperative relationship with the disk-shaped bottom spring contact member for enabling the disk-shaped bottom spring member to compress the at least one coil spring against the bottom of the pivot base flexible joint member, The pivot base flexible joint member of the present invention permits the sign post to usually absorb a vehicular impact by flexing the sign post at the pivot base flexible joint member, and in the event the quick change-out spring kit requires replacement, the removable attachment means may be removed and the tension means at the top may be released and the quick change-out spring kit may be removed and replaced with a new quick change-out spring kit.

Preferably, the tension means of the present invention comprises a cable or a chain. Also, desirably, in the case of the tension means being a cable, the tension means further includes an upper threaded member attached to the upper end of the cable and a lower threaded member attached to the lower end of the cable in the operative position.

The intermediate hollow bollard post desirably further includes an upper tension means support metallic disk member with a third central opening attached to the inner wall of the intermediate hollow bollard post in predetermined position. Preferably, the upper threaded member of the tension means passes through the third central opening of the upper tension means support metallic disk member and the tension adjustment-means preferably is provided with a first adjustment-release nut in operative engagement with the upper threaded member, whereby the tension of the cable may be adjusted.

The lower hollow bollard sign post of the present invention may have a square cross section. The top plate is square or rectangular shaped and sized to cover the top of the square lower hollow sign post. The top plate includes side flange mounts extending perpendicularly downwardly over opposite sides of the top of the square hollow lower bollard post in the operative position. Preferably, the side flange mounts have first apertures in alignment with second threaded apertures in the bottom hollow bollard post in the operative position. First bolt means pass through the first apertures of the side mounts and engage the threaded second apertures of the bottom hollow bollard post to maintain the quick change-out spring kit in position.

The at least one concentric spring may comprise an inner spring and an outer spring. Preferably, the upper sign post includes an upper sign carrying post attached to a lower sleeve sized to be insertable in the intermediate hollow bollard sign post and removably attached thereto. A sign is attached to the upper sign carrying post. The upper sign carrying post and the lower sleeve desirably consists essentially of an aluminum alloy.

The lower threaded member passes through the central opening of the disk-shaped bottom spring contact member to engage the locking member in the operative position.

Preferably, in a another embodiment, the tension means includes a chain which further includes a bottom threaded post having a top eyelet. The bottom threaded post passes through the disk-shaped bottom spring contact member with the top eyelet above the top of the disk-shaped bottom spring contact member in the operative position and the chain is in operative engagement with the top eyelet of the bottom threaded post. The tension means further includes a top threaded post having a bottom eyelet. The intermediate hollow bollard post further includes an upper tension means support metallic disk member with a third central opening attached to the inner wall of the intermediate hollow bollard post in predetermined position. The top threaded post upwardly passes through the third central opening of the upper tension means support metallic disk member with the bottom eyelet in operative position below the bottom of the upper chain stop metallic disk member. The chain being in operative engagement with the bottom eyelet of the top threaded post. In this configuration, the tension means includes a second adjustment-release nut in operative engagement with the top threaded post, whereby the tension of the chain may be adjusted.

Preferably in the first embodiment using a cable, the central opening has a minimum diameter larger than the diameter of the cable and the central opening at the top of the dome portion is substantially larger than the diameter of the central opening and gradually decreases in a tapered-fashion towards the bottom of the dome portion, whereby any fraying or pinching of the cable is prevented during impact on the sign post. In the second embodiment using a chain, desirably the central opening has a minimum diameter larger than the diameter of the maximum width of any link of the chain and the central opening at the top of the dome portion has a diameter substantially larger than the maximum width of any link of the chain and the diameter of the central opening gradually decreases in a tapered-curved-fashion towards the bottom of the dome portion, whereby any pinching of the chain is prevented during impact on the sign post.

A method for replacing the quick change-out spring kit of the present invention is also disclosed.

BRIEF DESCRIPTION OF THE DRAWINGS

Reference may be made to the accompanying drawings exemplary of the invention, in which.

DESCRIPTION OF THE PREFERRED EMBODIMENTS

Figure 1:
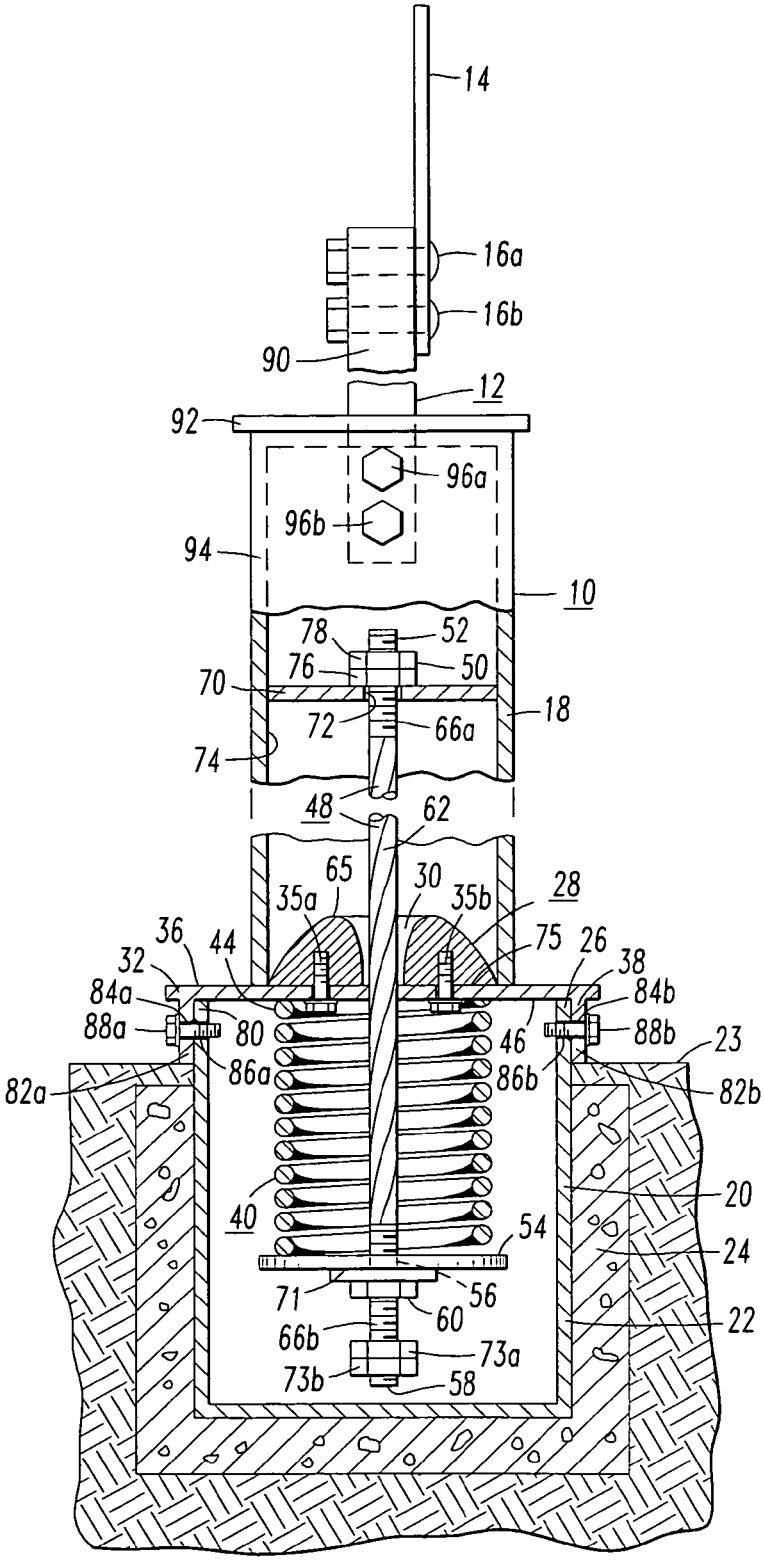
FIG. 1 is an elevation view of the impact absorbing sign post with a cable tension means partially broken away.

In FIG. 1 is shown an impact absorbing sign post 10 of the present invention with quick change-out capability. The impact absorbing sign post 10 includes an upper sign post 12 for carrying at least one sign 14. An intermediate cylindrical hollow bollard post 18 is positioned below the upper sign post 12 in supportive arrangement therewith. The upper sign post 12 is attached by attachment members 16 which may be cooperating bolts and nuts to the intermediate cylindrical hollow bollard post 18. A lower hollow bollard post 20 has a predetermined axial length such as 24 to 30 inches. It has a first or lower portion 22 having an axial length such as 21 to 30 inches and positioned as shown in FIG. 1 below ground level 23 and is attached to the ground by concrete 24, for example, to be immovable. A second or upper portion 26 of the lower hollow bollard post 20 may have an axial length such as 0 to 3 inches and is positioned above ground level 23. The upper portion 26 could be of negligible height if threaded flanges not shown are attached to the interior of the lower hollow bollard post 20 (not shown) and the pivot base flexible joint member 28 hereinafter described is attached by through bolts (not shown passing through joint member 28) engaging the threaded flanges.

A pivot base flexible joint member 28 having a central opening 30 predetermined maximum width such as ¾ to 1 inch. The pivot base flexible joint member 28 is removably attached to the lower hollow bollard post 20 proximate the second portion 26 thereof.

Figure 2:
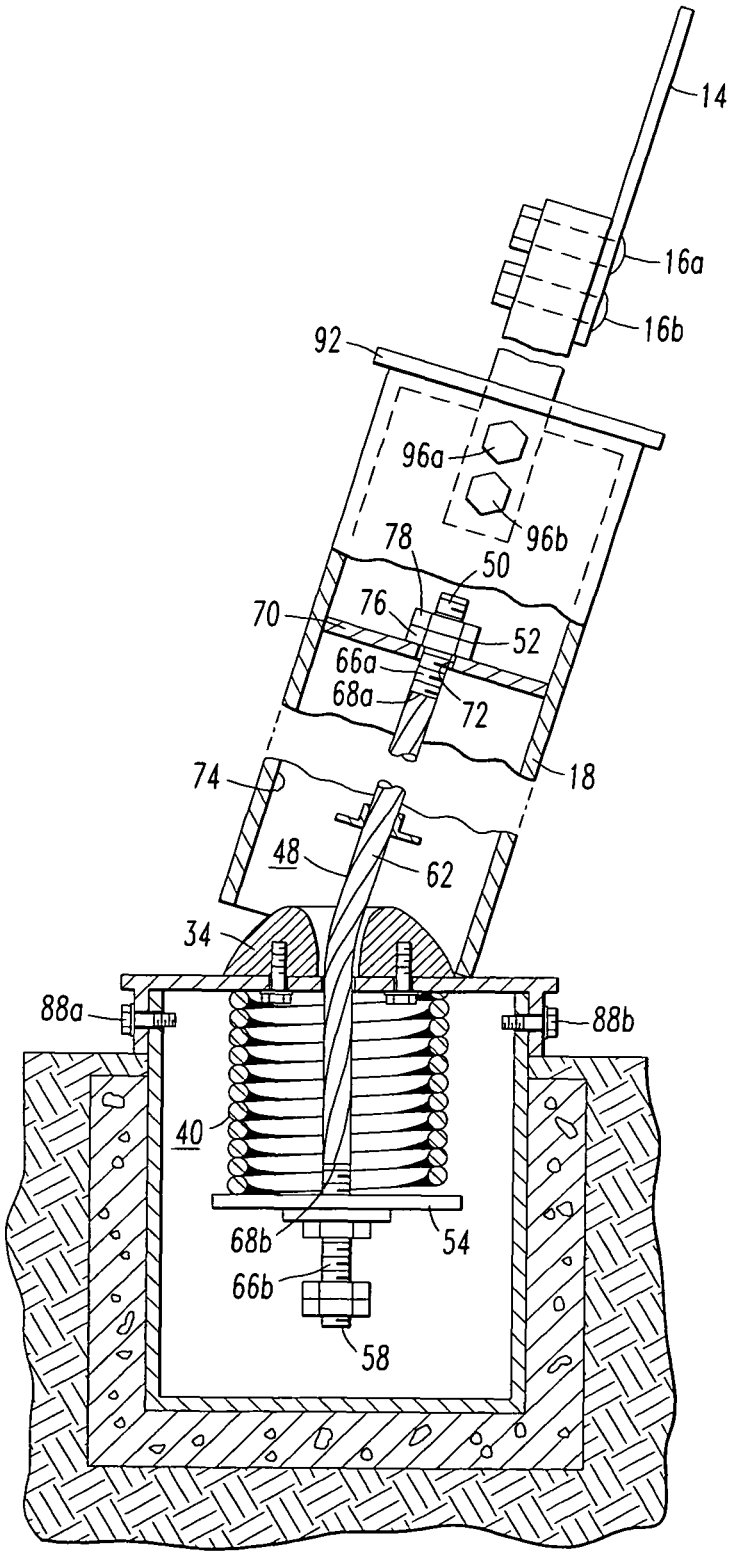
FIG. 2 is the same as FIG. 1 but depicting the impact absorbing sign post during impact with maximum flexure of the sign post.
Figure 4:
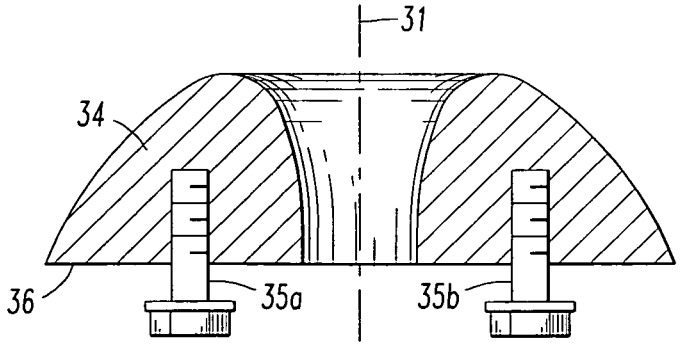
FIG. 4 is a sectional view of the dome portion.

The pivot base flexible joint member includes a top plate 32 sized to cover the top of the second portion 26 of the lower hollow bollard post 20. The second or upper portion 26 of the lower hollow bollard 20 may have a square cross-section have the dimensions 5 inches by 5 inches, for example. The top plate 32 may have the dimensions of 5½ inches by 5½ inches and be ¼ inch thick. The top plate 32 is in contacting and supportive relationship with respect to the intermediate hollow bollard post 20, as depicted in FIGS. 1 and 2. A dome portion 34 is centrally affixed to the upper surface 36 of the top plate 32. The dome portion 34 has a circular base 36 having a diameter such as 3 inches which is less than the inside diameter of the bottom of the intermediate hollow bollard post which is 3¼ inches, for example. The dome portion 34 has a semi-toroidal shape, like the upper half of a doughnut, and is in operative contacting arrangement with the intermediate hollow bollard post 18, as shown in FIGS. 1 and 2 for example. The dome portion 34 may be attached to the top plate 32 by dome bolts 35*a*, 35*b*, as shown in FIG. 4. The dome portion 34 may be made of a solid material such as steel. The central opening 30 of the pivot base flexible joint member 28 passes through the dome portion and the top plate as shown in FIG. 1. A removable attachment means 38 for attaching the pivot base flexible joint member 28 to the top of the lower bollard post 20 proximate the second portion 26 is included.

Figure 3:
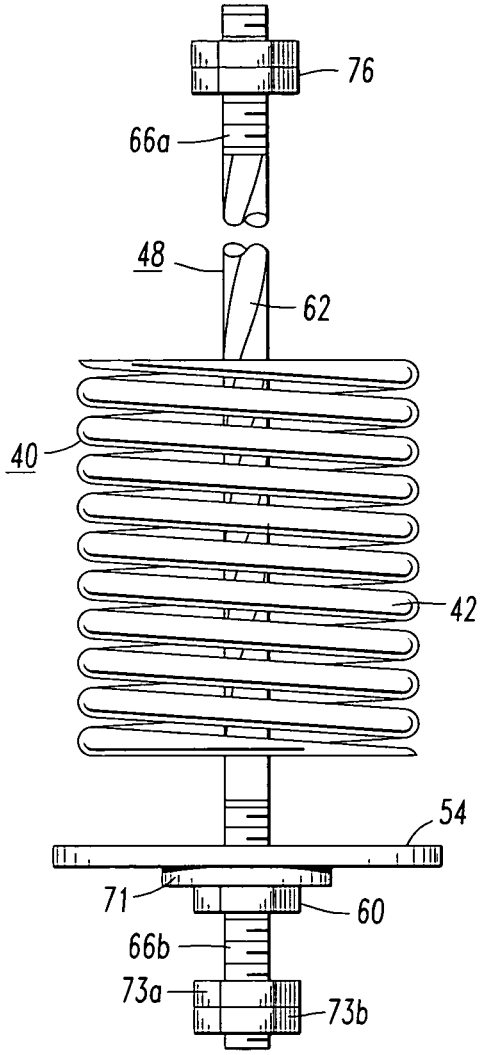
FIG. 3 is an elevation view of a portion of the spring change-out kit with a cable.

With reference to FIGS. 1-3, for example, a quick change-out spring kit 40 of the present invention substantially housed within the lower hollow bollard post 20. The quick change-out spring kit 40 includes at least one concentric coil spring 42 housed within the lower hollow bollard post 20. The coil spring 42 may be a compression spring. The coil spring 42 may comprise two concentric coil springs, i.e., inner spring and outer spring (not shown). In the operative position, the at least one concentric coil spring 42 at the top 44 thereof contacts the bottom surface 46 of the top plate 32 of pivot base flexible joint member 28 and is confined by the pivot base flexible joint member 28 within the lower hollow bollard post 20 in use. An elongated tension means 48 axially passes through the at least one coil spring 42 and the central opening 30 of the pivot base flexible joint member 28. The elongated tension means 48 includes a tension adjustment means 50 proximate the top portion 52 thereof. The elongated tension means 48 is removably attached proximate the top portion 52 thereof in predetermined position, as shown in FIG. 1, to the intermediate hollow bollard post 18. A disk-shaped bottom spring contact member 54 having a diameter such as 4 inches, which is about equal to or greater than the outer diameter of the bottom coil spring which is of the largest of the at least one concentric coil springs if more then one spring is used. The disk-shaped bottom spring contact member 54 having a second central opening 56 sized to accommodate the passage of the bottom portion 58 of the elongated tension means 48 therethrough. A locking member 60 is mounted on the bottom portion 58 of the tension means in cooperative relationship with the disk-shaped bottom spring contact member 54 for enabling the disk-shaped bottom spring member 54 to compress the at least one coil spring 42 against the bottom surface 46 of top plate 32 of the pivot base flexible joint member 28.

In a first embodiment of the impact absorbing sign post 10 of the present invention, the elongated tension means 48 may comprise a cable 62, for example. As can be seen in FIGS. 1-3, the cable 62 includes an upper threaded member 66*a* and a lower threaded member 66*b*. The cable 62 can be a stranded stainless steel wire cable with a maximum diameter of ⅜ inches and can be 22 to 24 inches long, for example. The upper threaded member 66*a* and lower threaded member 66*b* is attached to the cable 62 at it ends 68*a*, 68*b* by welding, for example. The central tapered opening 30 should have a minimum diameter greater than the maximum width of the cable 62 to allow the cable to pass unimpeded through the central tapered opening 30. The central opening 30 at the top 65 of the dome portion 34 is substantially larger than the diameter of the cable 62. The diameter of the central opening gradually decreases in a tapered-curved-fashion towards the bottom 75 of the dome portion 34, so that the dome portion 34 is semi-toroidal shaped, approximating one half of a doughnut shape, whereby any fraying or pinching of the cable is prevented during impact on the sign post. The curvature of the central opening 30 is upwardly tapering away from the center line 31 as shown in FIG. 4.

The intermediate hollow bollard post 18 also includes an upper tension means support metallic disk member 70 having a third central opening 72 passing through it. The upper tension means support metallic disk member 70 may be made of steel and is welded to the inner surface of the hollow bollard post 18 and positioned as shown in FIG. 1 for example.

With regard to the first embodiment of the invention, with reference to FIGS. 1-3, the upper threaded member 66*a* of the tension means 48 passes through the third central opening 72 of the upper tension means support metallic disk member 70. The tension adjustment means 50 for compressing the coil spring 42 to the desired compression includes a first adjustment-release nut 76 which operatively engages the upper threaded member 66*a*. The first adjustment-release nut 76 is tightened to achieve the desired tension on the cable 62 to compress the coil spring 42. A first locking nut 78 may be engaged on the upper threaded member 66*a* as shown in FIG. 1 to prevent the first adjustment-release nut 76 from unintentionally loosening. The lower threaded member 66*b* passes through the central opening 30 to engage the locking member nut 60, in the operative position. A washer 71 may also be included for setting the locking member 60 as shown in FIG. 1. In addition a pair of lower locking nuts 73*a*, 73*b* are placed on the lower threaded member 66*b* to act as a stop for locking member 60.

The lower hollow bollard sign post 20 may have a square cross section—not shown. The top plate 32 may be square or square-shaped, not shown, and sized to completely cover the top 20 of the lower hollow sign post. Of course, the lower hollow bollard sign post 20 could have a rectangular, circular, or other type cross-section and the top plate 32 would be designed in accordance with such structure to cover it. In the present embodiments the square-shaped top plate 32 includes side flange mounts 32 extending perpendicularly downwardly over opposite sides of the top 80 of the lower hollow bollard sign post 20 in the operative position. The side flange mounts 82*a*, 82*b* may be attached to the top 80 of the lower hollow sign post 20 by providing first apertures 84*a*, 84*b*, respectively, and second threaded apertures 86*a*, 86*b*, respectively, are provided in the bottom hollow bollard post 20. First bolts 88*a*, 88*b* pass through the first apertures 82*a*, 82*b* and engage the second threaded apertures 86*a*, 86*b* to maintain the quick change-out spring kit 40 in position.

The upper sign post 12 may include an upper sign carrying post 90 including a sealing cap 92 attached thereto by welding, for example. The sealing cap 92 is sized to cover top 94 of the intermediate hollow bollard post 18 and have a diameter slightly larger than the diameter of the intermediate hollow bollard post 18 to prevent rain, snow and debris from entering the intermediate hollow bollard post 18. The upper carrying sign post 90 may be attached proximate the top 94 of the intermediate hollow bollard post 18 by second bolts 96*a*, 96*b* and cooperating threaded holes in the upper sign carrying post 90, not shown. The upper sign carrying post 90 and the sealing cap 92 can made of various materials, such as metal e.g., steel or aluminum alloy or poly plastic products.

Figure 5:
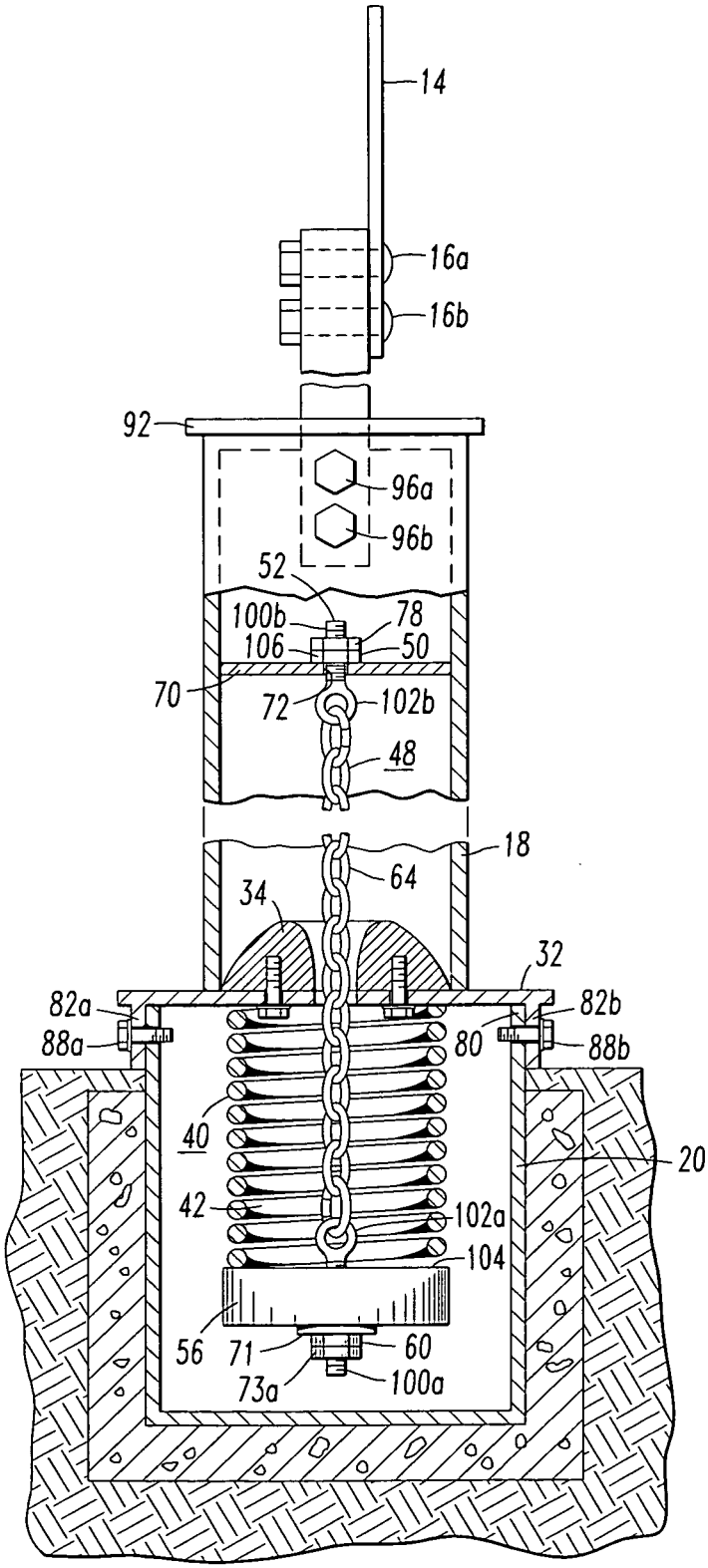
FIG. 5 is the same as FIG. 1, but with a chain instead of a cable.
Figure 6:
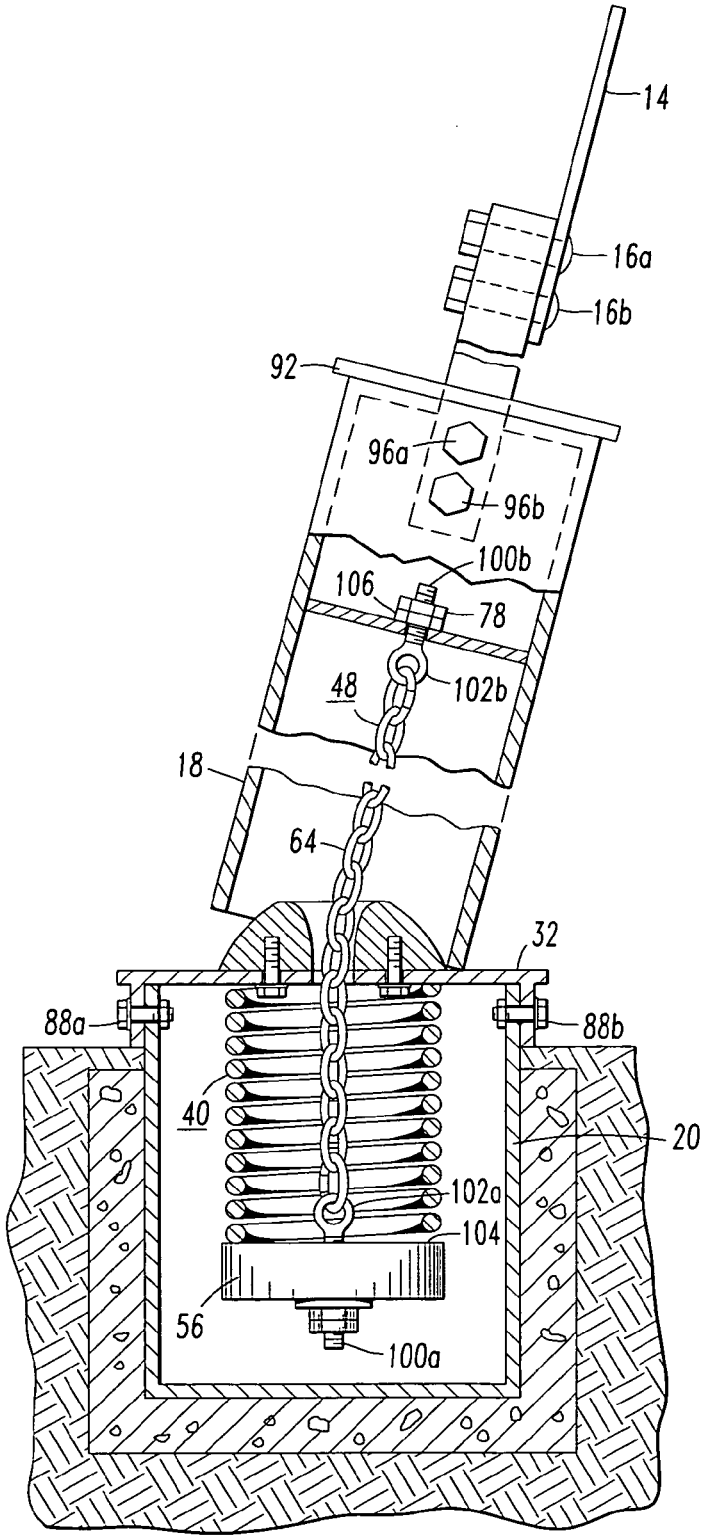
FIG. 6 is the same as FIG. 5, but showing the impact absorbing sign post during impact with maximum flexure; and, FIG. 7 is an elevation view of a portion of the spring change-out kit with a chain.
Figure 7:
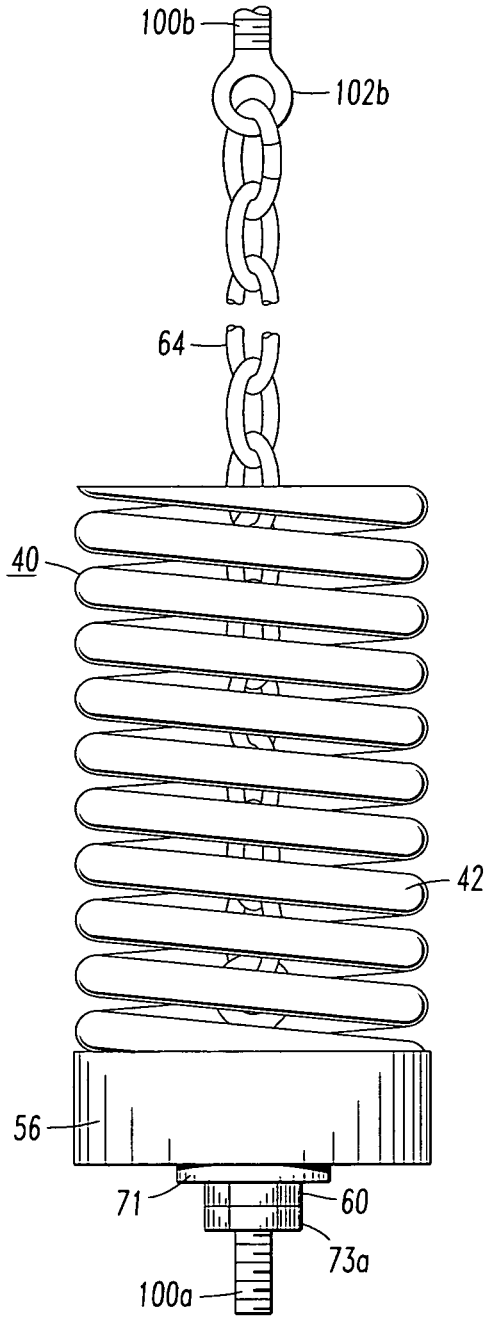

In a second embodiment of the invention the tension means 48 includes the chain 64 comprised of links 98. With regard to this embodiment depicted in FIGS. 5-7, like elements of this embodiment are identified by the same numerals as the first embodiment. The tension means 48 includes a bottom threaded post 100*a* having a top eyelet 102*a*. The bottom threaded post 100*a* passes through the disk-shaped bottom spring contact member 56 with the top eyelet 102*a* positioned above the top 104 of the disk-shaped bottom spring contact member 56. The chain 64 is in operative engagement with the top eyelet 102*a* as shown in FIG. 5. The tension means 48 also includes a top threaded post 100*b* having a bottom eyelet 102*b*. The top threaded post 100*b* upwardly passes through the third central opening 72 with the bottom eyelet operatively positioned below the bottom of the upper support metallic disk member 70. The tension adjustment means 50 includes a second adjustment-release nut 106 in operative engagement with the top threaded post 100*b*. The tension of the chain 64 may be adjusted by tightening or loosening the second adjustment-release nut 106.

With regard to the second embodiment, the central-curved-tapered opening 30 should have a minimum diameter greater than the maximum width of any link 98 of the chain 64 to allow the chain to pass unimpeded through the central tapered opening 30.

The method of the invention for replacing the quick change-out spring kit 40 of the impact absorbing sign post 10, having a structure as already described, includes the steps of:

a. removing the upper sign post 12 from the intermediate hollow bollard post 18, b. releasing the elongated tension means 48 from the attachment to the intermediate hollow bollard post 18, c. releasing the pivot base flexible joint member 28 from the top 80 of the lower hollow bollard post 20, d. removing the quick change-out spring kit 40 from the lower hollow bollard post 20, e. inserting the replacement quick change-out spring kit 40, f. re-attaching the pivot base flexible joint member 28 to the top 80 of the lower bollard post, g. attaching the elongated tension means 48 to the intermediate hollow bollard post 18, and h. re-attaching the upper sign post 12 to the intermediate hollow bollard post 18.

With regard to step a. in order to release the sign post 12 second bolts 96*a*, 96*b* must be removed. With regard to step b. in order to release elongated tension means 48 from the attachment to the intermediate hollow bollard post 18, the first locking nut 78, and the first or second adjustment-release nut 76 must be removed. In step c. the first bolts 88*a*, 88*b* are removed from the corresponding second threaded apertures 86*a*, 86*b*. In step d. the quick change-out spring kit 40 is removed by lifting the top plate 32 together with the intermediate hollow bollard post 18 completely off the lower hollow bollard post 20. The tension means 48 with the cable 62 or chain 64 slides through the central aperture 30, the replacement quick change-out spring kit 40 may not be installed in a reverse manner.

It is apparent various modifications can be made to the within described embodiments without departing from the scope of the present invention.

What is claimed is:

1. An impact absorbing sign post with quick change-out capability comprising:

an upper sign post for carrying at least one sign, an intermediate cylindrical hollow bollard post positioned below the upper sign post in supportive arrangement therewith, the upper sign post removably attached to the intermediate hollow bollard post, a lower hollow bollard post of predetermined axial length, a first portion of predetermined axial length of the lower hollow bollard post positioned below ground level and attached to the ground to be immovable, a second portion of the lower hollow bollard of a predetermined axial length substantially less than the first portion positioned above ground level, a pivot base flexible joint member having a central opening of predetermined size, the pivot base flexible joint member removably attached to the lower hollow bollard post proximate the second portion thereof, the pivot base flexible joint member includes a top plate sized to cover the top of the second portion of the lower hollow bollard post and in contacting and supportive relationship with the intermediate hollow bollard post, a dome portion centrally affixed to the upper surface of the top plate, the dome portion having a circular base having a diameter a predetermined amount less than the inside diameter of the bottom of the intermediate hollow bollard post, the dome portion having a semi-toroidal shape, the dome portion in operative contacting arrangement with the intermediate hollow bollard post, the central opening of the pivot base flexible joint member passing through the dome portion and the top plate, removable attachment means for attaching the pivot base flexible joint member to the top of the lower bollard post proximate the second portion thereof, a quick change-out spring kit substantially housed within the lower hollow bollard post, the quick change-out spring kit including at least one concentric coil spring housed within the lower hollow bollard post in the operative position, the at least one concentric coil spring at the top thereof contacting the bottom surface of the top plate of pivot base flexible joint member and confined by the pivot base flexible joint member within the lower hollow bollard post, an elongated tension means comprising a cable axially passing through the at least one coil spring and the central opening of the pivot base flexible joint member, the cable having an upper end and a lower end, the elongated tension means includes a tension adjustment means proximate the top portion thereof including an upper threaded member attached to the upper end of the cable in the operative position, the elongated tension means including a lower threaded member attached to the lower end of the cable in the operative position, the intermediate hollow bollard post further includes an upper tension means support metallic disk member having a third central opening passing therethrough, the upper tension means support metallic disk member is operatively attached to the inner wall of the intermediate hollow bollard post in predetermined position, the elongated tension means removably attached proximate the top thereof in predetermined position to the intermediate hollow bollard post, a disk-shaped bottom spring contact member having a diameter about equal to or greater than the outer diameter of the bottom coil of the largest of the at least one concentric coil springs, the disk-shaped bottom spring contact member having a second central opening sized to accommodate the passage of the lower threaded member of the elongated tension means therethrough, a locking member mounted on the lower threaded member of the tension means in cooperative relationship with the disk-shaped bottom spring contact member for enabling the disk-shaped bottom spring member to compress the at least one coil spring against the bottom of the pivot base flexible joint member, whereby the pivot base flexible joint member permits the sign post to usually absorb a vehicular impact by flexing the sign post at the pivot base flexible joint member and in the event the quick change-out spring kit requires replacement the removable attachment means may be removed and the tension means at the top is released and the quick change-out spring kit may be removed and replaced with a new quick change-out spring kit.

2. The impact absorbing sign post of claim 1, wherein the upper threaded member of the tension means passes through the third central opening of the upper cable tension means support metallic disk member, the tension adjustment means includes a first adjustment-release nut in operative engagement with the upper threaded member, whereby the tension of the cable may be adjusted.

3. The impact absorbing sign post of claim 1, wherein the lower hollow bollard sign post has a square cross section, the top plate is square sized to cover the top of the square lower hollow sign post and includes side flange mounts extending perpendicularly downwardly over opposite sides of the top of the square hollow lower bollard post in the operative position.

4. The impact absorbing sign post of claim 3, wherein the side flange mounts have first apertures in alignment with second threaded apertures in the bottom hollow bollard post in the operative position, first bolt means pass through the first apertures of the side mounts and engage the threaded second apertures of the bottom hollow bollard post to maintain the quick change-out spring kit in position.

5. The impact absorbing sign post of claim 3, wherein the at least one concentric spring comprises an inner spring and an outer spring.

6. The impact absorbing sign post of claim 1, wherein the upper sign post further comprises a sealing cap attached thereto in predetermined position, said sealing cap sized to cover the top of intermediate hollow bollard sign post.

7. The impact absorbing sign post of claim 6, wherein both the upper sign carrying post and the sealing cap comprises metal or plastic.

8. The impact absorbing sign post of claim 1, wherein the lower threaded member passes through the central opening of the disk-shaped bottom spring contact member to engage the locking member in the operative position.

9. The impact absorbing sign post of claim 1, wherein the central opening of has a minimum diameter greater than the minimum diameter of the cable, and central opening at the top of the dome portion is substantially larger than the diameter of the cable, the diameter of the central opening gradually decreases in a tapered-fashion towards the bottom of the dome portion, whereby any fraying or pinching of the cable is prevented during impact on the sign post.

* * * * *